US012622512B1

(12) United States Patent
Johns et al.

(10) Patent No.: US 12,622,512 B1
(45) Date of Patent: May 12, 2026

(54) MULTI-PURPOSE CABINET

(71) Applicants: Michelle Johns, Baltimore, MD (US); Stephanie Johns, Baltimore, MD (US)

(72) Inventors: Michelle Johns, Baltimore, MD (US); Stephanie Johns, Baltimore, MD (US)

( * ) Notice: Subject to any disclaimer, the term of this patent is extended or adjusted under 35 U.S.C. 154(b) by 0 days.

(21) Appl. No.: 18/377,853

(22) Filed: Oct. 9, 2023

(51) Int. Cl.
*A47B 46/00* (2006.01)
*A47B 67/00* (2006.01)

(52) U.S. Cl.
CPC ..... *A47B 46/005* (2013.01); *A47B 67/005* (2013.01); *A47B 2220/0075* (2013.01)

(58) Field of Classification Search
CPC ..... A47B 46/005; A47B 67/005; A47B 2220/0075
USPC .... 312/224, 225, 226, 227, 245, 313, 321.5, 312/282
See application file for complete search history.

(56) References Cited

U.S. PATENT DOCUMENTS 3,140,134 A * 7/1964 Nairn ..... A47K 5/02 312/227
3,684,344 A * 8/1972 Gilinger ..... A47B 49/002 312/223.5
4,502,742 A 3/1985 Neff
4,663,621 A * 5/1987 Field ..... G07C 9/0069 600/479
4,989,506 A * 2/1991 McCormick ..... B65F 1/14 34/80
5,577,819 A 11/1996 Olsen
5,584,546 A * 12/1996 Gurin ..... A47B 21/00 312/200
5,954,411 A * 9/1999 Katz ..... A47B 67/02 312/224
8,047,851 B1 11/2011 Baxter
(Continued)

FOREIGN PATENT DOCUMENTS

CN 215590584 * 1/2022 ..... B60P 3/36

OTHER PUBLICATIONS

25+ Weed Stash Boxes to Securely Store Cannabis (Updated). Article [online]. marijuanamommy.com [retrieved on Nov. 10, 2022]. Retrieved from the Internet: <URL: https://www.marijuanamommy.com/20-weed-stash-boxes-securely-store-cannabis/amp/>.

(Continued)

*Primary Examiner* — James O Hansen
(74) *Attorney, Agent, or Firm* — Cramer Patent & Design, PLLC.; Aaron R. Cramer

(57) ABSTRACT

A multi-purpose cabinet with several functions may consist of a body, a door, a tray, several shelves, multiple containers, and at least one receptacle. The cabinet is designed to effectively store a smoking product in a manner that prevents unauthorized individuals from gaining access to the smoking substance. For illustrative purposes, the smoking product could include tobacco or marijuana, among others. The cabinet body and door have the capability to be securely sealed and secured, so providing an enclosed space for the storage of smoking products and their associated supplies. When the cabinet door is in an open position, the tray has the capability to fold down and function as a work surface for the preparation of smoking materials. The smoking substance has the potential to be stored in multiple containers. Smoking waste can be gathered in one or more containers.

1 Claim, 3 Drawing Sheets

(56) References Cited

U.S. PATENT DOCUMENTS

| | | | | |
|---|---|---|---|---|
| 8,870,307 | B1 * | 10/2014 | Provenzano | A45D 44/02 312/224 |
| D717,081 | S | 11/2014 | Dworman | |
| 8,910,402 | B2 * | 12/2014 | Mischel, Jr. | G09F 19/14 362/135 |
| 11,317,715 | B2 | 5/2022 | Long | |
| 2004/0108796 | A1 * | 6/2004 | Brower | A47B 67/00 312/245 |
| 2005/0231082 | A1 | 10/2005 | Sacco et al. | |
| 2006/0119235 | A1 * | 6/2006 | Aisley | A47B 47/00 312/227 |
| 2007/0159035 | A1 * | 7/2007 | Mullen | A47B 46/005 312/245 |
| 2010/0011645 | A1 * | 1/2010 | Milburn-Hall | A47B 46/005 40/724 |
| 2012/0206026 | A1 | 8/2012 | Emelio | |
| 2013/0229764 | A1 * | 9/2013 | Coster | H05K 5/0221 312/223.2 |
| 2014/0265768 | A1 * | 9/2014 | Diemel, Jr. | A47B 67/02 312/224 |
| 2015/0254603 | A1 * | 9/2015 | Bashkin | G06V 40/70 312/237 |
| 2015/0320209 | A1 * | 11/2015 | Hasselback | A47B 95/00 312/227 |
| 2016/0088933 | A1 | 3/2016 | Rossignol | |
| 2018/0086518 | A1 | 3/2018 | Charm | |
| 2019/0174917 | A1 * | 6/2019 | Diemel | A47B 67/02 |
| 2021/0401034 | A1 | 12/2021 | McCloud et al. | |
| 2022/0002064 | A1 | 1/2022 | Carlos-Wallace | |

OTHER PUBLICATIONS

Cannabis Storage Safe With Slide-Out Shelving. Product listing [online]. Canadian Safe Manufacturing Ltd. [retrieved on Nov. 10, 2022]. Retrieved from the Internet: <URL: https://canadiansafe.ca/product/cannabis-storage-safe-with-slide-out-shelving/>.

Looking for the Best Weed Accessories? Medical Marijuana Accessories Are Here!. Article [online]. Copyright © 2023 CalmEffect.com [retrieved on Nov. 10, 2022]. Retrieved from the Internet: <URL: https://www.calmeffect.com/medical-marijuana-accessories/>.

* cited by examiner

MULTI-PURPOSE CABINET

RELATED APPLICATIONS

None.

FIELD OF THE DEVICE

The present device relates to a multi-purpose cabinet and more specifically to a multi-purpose cabinet having unique features related to the storage and disposal of smoking products.

BACKGROUND OF THE DEVICE

The act of smoking, whether it pertains to the consumption of tobacco or marijuana, has been a prevalent recreational and medical activity for numerous generations. Nevertheless, with the progression of rules pertaining to the utilization of these compounds, there has emerged a corresponding necessity for storage solutions that prioritize safe practices. One of the foremost issues that has emerged is to the imperative of safely storing smoking products and their related paraphernalia in a manner that effectively deters illegal access, notably by minors and animals, while simultaneously ensuring the preservation of the stored materials' freshness and quality.

The conventional storage methods employed for smoking products frequently exhibit insufficient security measures to effectively address these concerns. Conventional storage options, such as drawers, cabinets, or containers, may present a risk to safety and compromise the integrity of stored items due to their ease of accessibility to inquisitive individuals. Furthermore, the necessity for a discreet, user-friendly, and adaptable storage solution has gained significance in light of the escalating demand for legalized marijuana and controlled tobacco products.

In light of the aforementioned challenges, the current device presents a novel storage cabinet for smoking products. The purpose of this cabinet is to cater to the unique requirements of various users, including medical marijuana patients who are legally obligated to limit access to their supplies, as well as others in search of a secure and easy storage option for their smoking paraphernalia. The cabinet incorporates several attributes, such as doors that can be locked, trays that can be folded down for the purpose of preparing smoking materials, and shelves that facilitate systematic storage of containers and supplies. Additionally, it integrates features like as LED illumination, humidity regulation, and the ability to personalize the device with aesthetic embellishments in a manner that is cost effective and safe.

SUMMARY OF THE DEVICE

Embodiments of the present disclosure may include a cabinet for securely storing smoking products, including a cabinet body including a top panel. Embodiments may also include a bottom panel. Embodiments may also include a left side panel. Embodiments may also include a right panel.

Embodiments may also include a rear panel. Embodiments may also include a cabinet door hingedly coupled to the cabinet body, the cabinet door having a lock operable to prevent unauthorized access when in a locked state. Embodiments may also include a tray hingedly coupled to an inside surface of the cabinet door, the tray being movable between a tray up position and a tray down position.

Embodiments may also include a plurality of shelves coupled to the cabinet body for holding containers and other items. Embodiments may also include a plurality of containers for storing smoking products, the containers having open tops and, optionally, container lids. Embodiments may also include at least one receptacle for collecting a plurality of used smoking products.

Embodiments may also include one or more cabinet door hinges for facilitating opening and closing of the cabinet door. Embodiments may also include one or more tray hinges for facilitating movement of the tray. Embodiments may also include one or more tray clips operable to hold the tray in the tray up position. Embodiments may also include a mirror on an inside of the rear panel for reflecting an image of a user when the cabinet door may be in an open position.

Embodiments may also include a lock on the cabinet door operable to move between a locked state and an unlocked state. In some embodiments, the lock may be a mechanical lock or a fingerprint reader. Embodiments may also include a plurality of LED lights may be coupled to the inside of the rear panel for illuminating an interior of the cabinet.

In some embodiments, the cabinet body may be configured to be mountable to a wall. In some embodiments, the plurality of shelves may include at least one shelf that may be less than a full width of the cabinet body. In some embodiments, the tray clips may be configured to be detachably coupled to the tray by magnetic attraction, and optionally being decorative. In some embodiments, the at least one receptacle being made of a flame-retardant material. In some embodiments, the plurality of LED lights being powered by an external power adapter.

In some embodiments, the smoking product may include tobacco. In some embodiments, the smoking product may include marijuana. In some embodiments, the cabinet door may be transparent. In some embodiments, the cabinet may include a ventilation system for controlling odor within the cabinet.

In some embodiments, the plurality of containers may be transparent. In some embodiments, the cabinet door may be made of a material that blocks ultraviolet (UV) light to preserve a freshness of the smoking product. In some embodiments, the cabinet may include a humidity control system to maintain an optimal humidity level for the smoking product.

In some embodiments, the plurality of LED lights may be programmable to change colors and patterns. In some embodiments, the cabinet body includes a locking mechanism that prevents the cabinet body from being opened without first unlocking the cabinet door. In some embodiments, the cabinet may include a security alarm system that may be triggered when unauthorized access may be attempted.

In some embodiments, the cabinet may be designed to blend in with home decor, appearing as a regular wall cabinet when closed. In some embodiments, the cabinet may include a built-in ashtray in the tray for convenient disposal of a quantity of ash and the plurality of used smoking products. In some embodiments, the cabinet door includes a transparent section to allow the user to see a content of the cabinet without opening the cabinet door.

In some embodiments, the cabinet may include a locking mechanism that can be remotely controlled via a mobile app or a website. In some embodiments, the cabinet may be designed to be childproof, with childproof locks and latches. In some embodiments, the cabinet may include a ventilation system with activated carbon filters to eliminate odors.

In some embodiments, the cabinet door includes a digital keypad for entering a PIN code to unlock the cabinet. In some embodiments, the cabinet may include a timer or scheduling feature to control when the cabinet can be opened. In some embodiments, the cabinet may include a built-in scale for measuring a weight of the smoking product.

BRIEF DESCRIPTION OF THE DRAWINGS

The advantages and features of the present device will become better understood with reference to the following more detailed description and claims taken in conjunction with the accompanying drawings, in which like elements are identified with like symbols, and in which:

DESCRIPTIVE KEY

Figure 1:
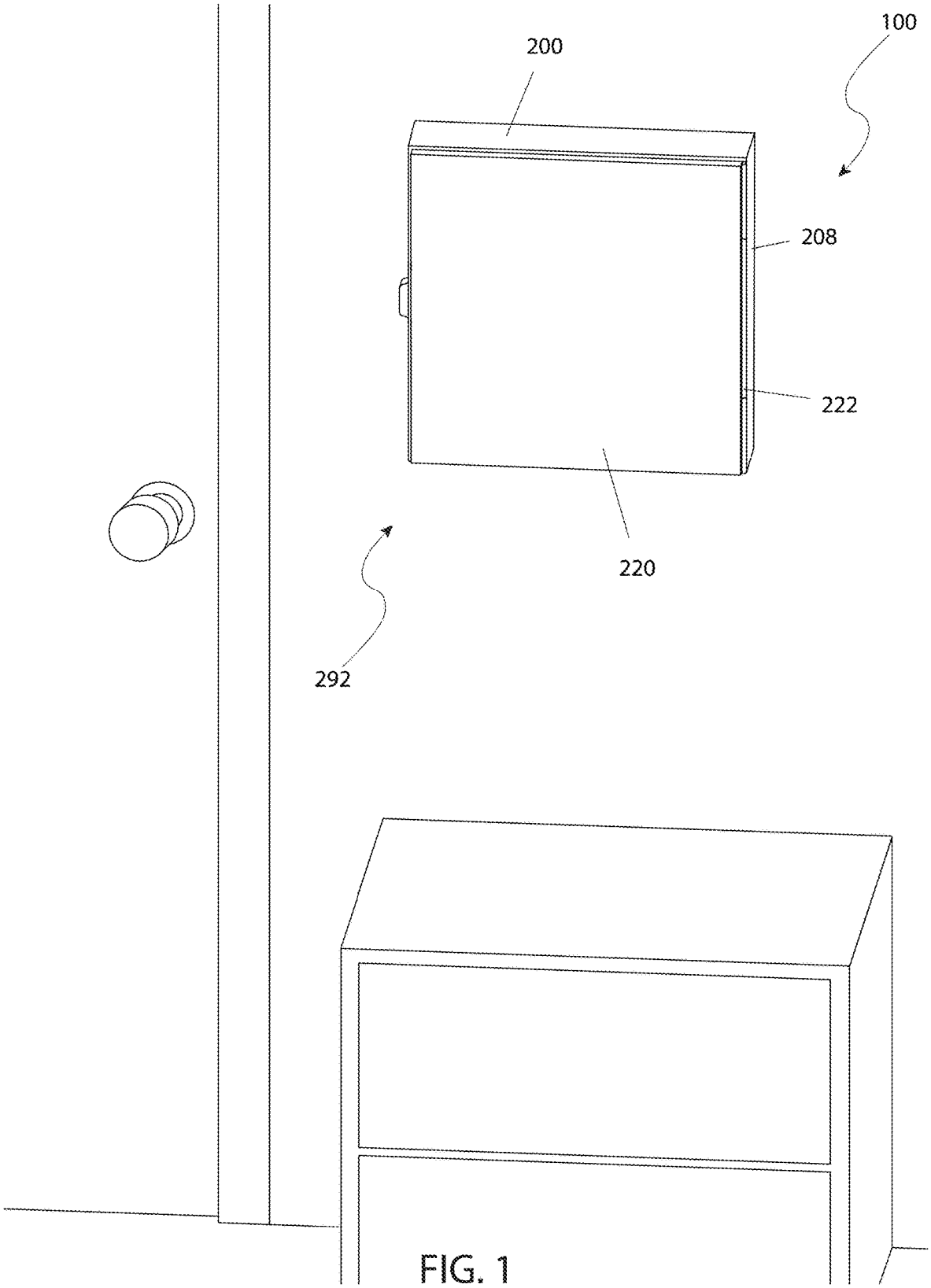
FIG. 1 is an in-use view of a cabinet 100, according to an embodiment of the present device, illustrating the cabinet door 220 in the closed position 292.
Figure 2:
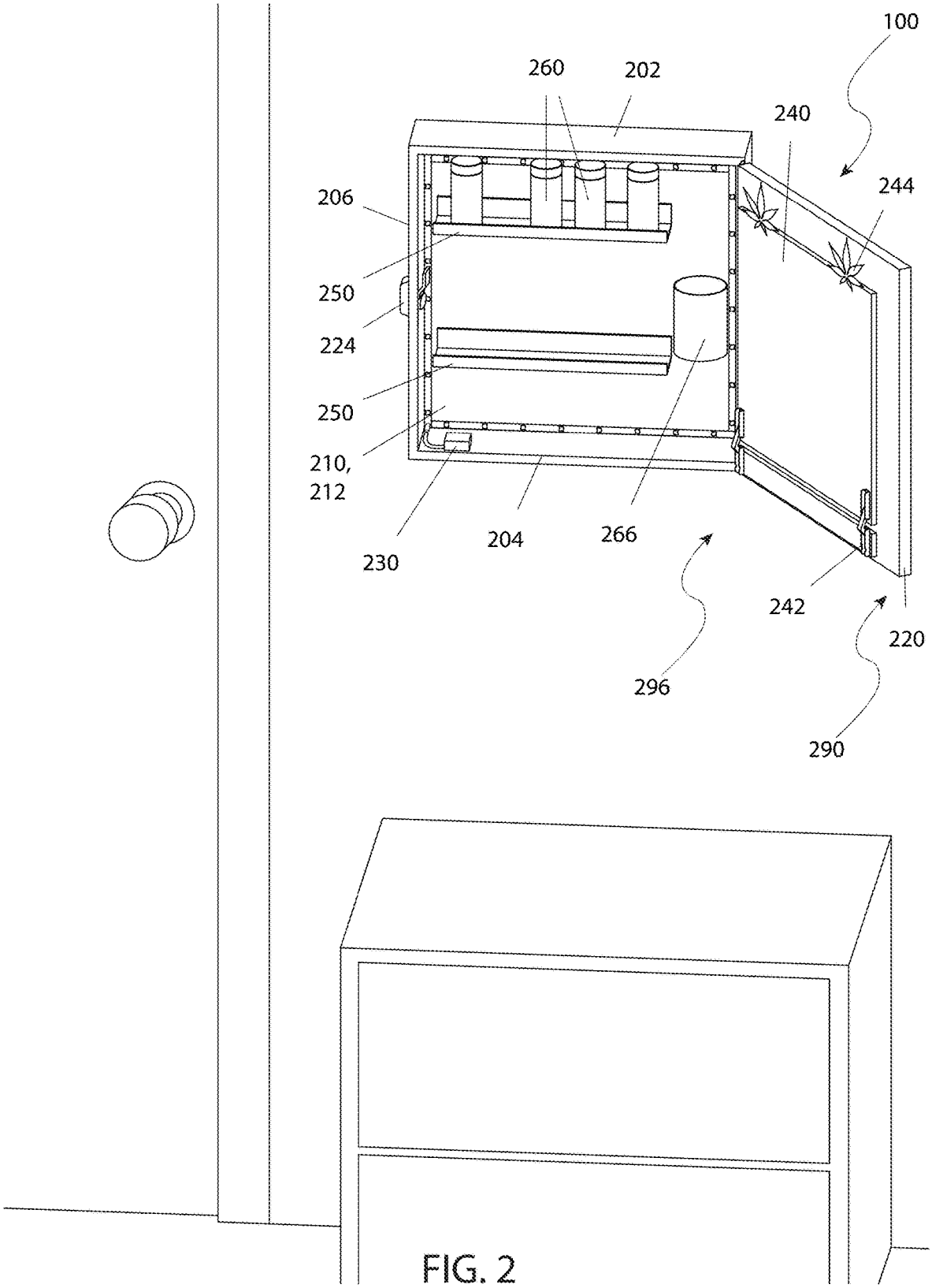
FIG. 2 is an in-use view of a cabinet 100, according to an embodiment of the present device, illustrating the cabinet door 220 in the open position 290 and the tray 240 in the tray up position 296; and, FIG. 3 is an in-use view of a cabinet 100, according to an embodiment of the present device, illustrating the cabinet door 220 in the open position 290 and the tray 240 in the tray down position 294.
Figure 3:
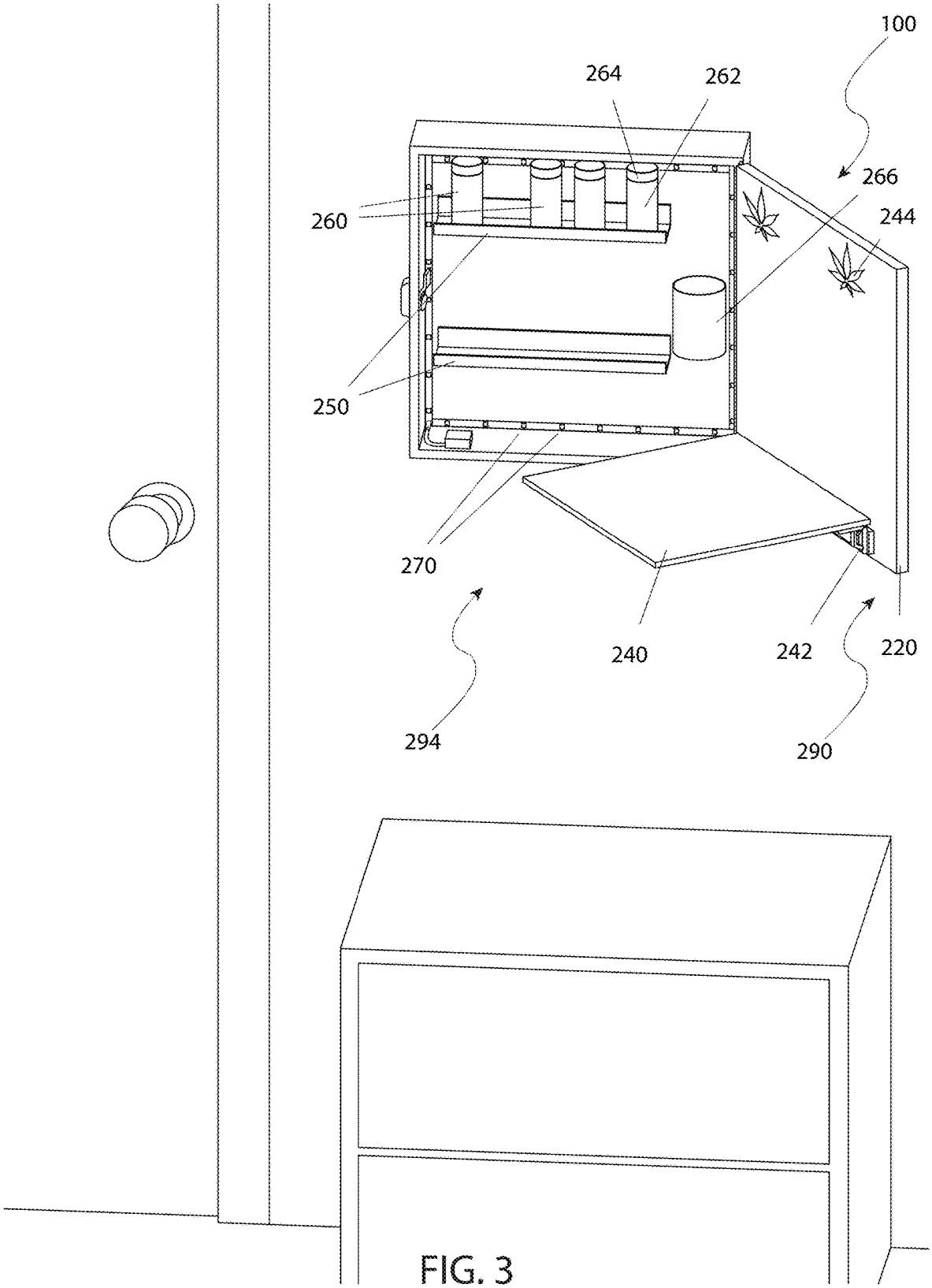

100 cabinet
200 cabinet body
202 top panel
204 bottom panel
206 left side panel
208 right panel
210 rear panel
212 mirror
220 cabinet door
222 cabinet door hinge
224 lock
230 fingerprint reader
240 tray
242 tray hinge
244 tray clip
250 shelf
260 container
262 container body
264 container lid
266 receptacle
270 LED light
290 open position
292 closed position
294 tray down position
296 tray up position

1. DESCRIPTION OF THE DEVICE

The present device is directed to a cabinet (herein described as the "cabinet") 100. The cabinet 100 may comprise a cabinet body 200, a cabinet door 220, a tray 240, a plurality of shelves 250, a plurality of containers 260, and at least one (1) receptacle 266. The cabinet 100 may be operable to securely store a smoking product to prevent unauthorized access to the smoking product. As non-limiting examples, the smoking product may be tobacco or marijuana. The cabinet body 200 and the cabinet door 220 may be sealed and locked to enclose the smoking product and associated supplies. With the cabinet door 220 open, the tray 240 may fold down and may be operable as a work area for rolling the smoking product. The smoking product may be stored in the plurality of containers 260. Butts may be collected in at least one (1) receptacle 266.

As a non-limiting example, a user may have a medical marijuana permit that obligates the user to store the smoking product such that children and pets cannot access the smoking product. The cabinet 100 may fulfill such an obligation.

The cabinet body 200 may be a rectangular cuboid having an open front. Specifically, the cabinet body 200, may comprise a top panel 202, a bottom panel 204, a left side panel 206, a right panel 208, and a rear panel 210. The cabinet body 200 may be mounted on a wall by passing mounting hardware through the rear panel 210 of the cabinet body 200 and into the wall. The cabinet door 220 may be hingedly coupled to the cabinet body 200 by one (1) or more cabinet door hinges 222 such that the open front of the cabinet body 200 may permit access to the interior of the cabinet body 200 when the cabinet door 220 is in an open position 290 and the cabinet door 220 may block access to the interior of the cabinet body 200 when the cabinet door 220 is in a closed position 292.

In some embodiments, the rear panel 210 may comprise a mirror 212 on the inside of the cabinet body 200 that may be adapted to reflect an image of the user when the cabinet door 220 is in the open position 290.

The cabinet door 220 may comprise a lock 224 that may be operable to prevent the cabinet door 220 from being opened when the lock 224 is in a locked state. The lock 224 may permit the cabinet door 220 to move between the closed position 292 and the open position 290 when the lock 224 is in an unlocked state. As a non-limiting example, the lock 224 may be a mechanical lock that may be locked and unlocked using a key. In some embodiments, the lock 224 may comprise a fingerprint reader 230 that may electrically unlock the lock 224 based upon recognition of a previously learned fingerprint.

The tray 240 may provide a work surface for preparing the smoking product. As a non-limiting example, rolling paper may be placed on the tray 240 and the smoking product may be placed on the rolling paper and rolled. The tray 240 may be hingedly coupled to the inside surface of the cabinet door 220 via one (1) or more tray hinges 242. The tray 240 may move between a tray up position 296 and a tray down position 294 when the cabinet door 220 is open. In the tray down position 294, the tray 240 may form an angle of ninety degrees with an error of five degrees (90.0+/−) 5.0° with respect to the cabinet door 220.

One (1) or more tray clips 244 may be coupled to the inside surface at the top of the cabinet door 220 and may be operable to hold the tray 240 in the tray up position 296. In some embodiments, the tray clips 244 may detachably couple to the tray 240 by magnetic attraction between the tray clips 244 and the tray 240. In some embodiments, the tray clips 244 may also be decorative. As a non-limiting example, the tray clips 244 may be the shaped of cannabis leaves.

The plurality of shelves 250 may be rigid, horizontally-oriented planes that may be operable to hold the plurality of containers 260 and other items that may be stored within the cabinet body 200. The plurality of shelves 250 may be coupled to the rear panel 210, the left side panel 206, the right panel 208, or any combination thereof. In some embodiments, the plurality of shelves 250 may be clear.

In a preferred embodiment, there may be one (1) to five (5) shelves. In a preferred embodiment, a subset of the plurality of shelves 250 may be less than the full width of the cabinet body 200. As a non-limiting example, the subset of the plurality of shelves 250 may be three-quarters (¾) of the width of the cabinet body 200.

As used herein, "subset" may refer to a relationship between two (2) sets. Set 'A' may be said to be a subset of set 'B' if all elements of set 'A' are also elements of set 'B'. The definition of subset allows that the membership of set 'A' may equal the membership of set 'B' or that set 'A' may be an empty set, meaning that the subset may have no members.

The plurality of containers 260 may be vessels for storing the smoking product, supplies, utensils, or combinations thereof. The plurality of containers 260 may comprise a container body 262 having an open top through which the contents are accessed. A subset of the plurality of containers 260 may comprise a container lid 264 such that the plurality of containers 260 may be closed to preserve the freshness of the smoking product inside.

The at least one (1) receptacle 266 may be an open-top vessel for holding the butts created during consumption of the smoking product. The at least one (1) receptacle 266 may detachably couple to the rear panel 210, the left side panel 206, the right panel 208, or any combination thereof. The at least one (1) receptacle 266 may be made of a flame-retardant material.

The cabinet 100 may further comprise a plurality of LED lights 270 that may be coupled to the inside of the rear panel 210 around the perimeter of the rear panel 210. The plurality of LED lights 270 may be adapted to illuminate the interior of the cabinet body 200, the tray 240, the user, or any combination thereof. The plurality of LED lights 270 may be powered by an external power adapter.

In preferred embodiments, the cabinet 100 may be available in one (1) of three (3) sizes. A large size may have a width of twenty inches with an error of one-half inch (20.0+/−0.5 in.) and a height of twenty inches with an error of one-half inch (20.0+/−0.5 in.). A medium size may have a width of twelve inches with an error of one-half inch (12.0+/−0.5 in.) and a height of twelve inches with an error of one-half inch (12.0+/−0.5 in.). A small size may have a width of eight inches with an error of one-half inch (8.0+/−0.5 in.) and a height of eight inches with an error of one-half inch (8.0+/−0.5 in.).

In use, the cabinet body 200 may be mounted on a wall. Smoking products, rolling paper, utensils, rolled smoking products, and so on may be stored within the cabinet body 200. As non-limiting examples, the smoking products may comprise tobacco, marijuana, or both. The cabinet door 220 may be pivoted to the closed position 292 and locked to prevent unauthorized access by children, pets, or others. The cabinet door 220 may be unlocked and pivoted to the open position 290 to access the smoking product. The tray 240 may be pivoted to the tray down position 294 and used as a work surface for rolling the smoking product in the rolling paper.

The exact specifications, materials used, and method of use of the cabinet 100 may vary upon manufacturing. The foregoing descriptions of specific embodiments of the present device have been presented for purposes of illustration and description. They are not intended to be exhaustive or to limit the cabinet to the precise forms disclosed, and obviously many modifications and variations are possible in light of the above teaching. The embodiments were chosen and described in order to best explain the principles of the cabinet and its practical application, to thereby enable others skilled in the art to best utilize the cabinet and various embodiments with various modifications as are suited to the particular use contemplated.

What is claimed is:

1. A cabinet for securely storing a smoking product, consisting of:

a cabinet body consisting of:

a top panel;

a bottom panel;

a left side panel;

a right panel; and, a rear panel;

wherein the cabinet body defines an open front, and wherein the rear panel is adapted to mount the cabinet body to a wall by passing mounting hardware through the rear panel;

a cabinet door hingedly coupled to the cabinet body by at least one cabinet door hinge, the cabinet door being movable between a closed position and an open position;

a lock engaging the cabinet door, wherein the lock is a fingerprint reader configured to electrically unlock the cabinet door based upon recognition of a previously learned fingerprint, the lock being operable to prevent the cabinet door from being opened when in a locked state;

a tray hingedly coupled to an interior surface of the cabinet door by at least one tray hinge, the tray being movable between a tray up position and a tray down position when the cabinet door is in the open position, wherein in the tray down position the tray forms an angle of ninety degrees with an error of five degrees (90.0±5.0° with respect to the cabinet door;

a plurality of tray clips disposed at a top portion of the interior surface of the cabinet door, wherein the tray clips detachably couple to the tray by magnetic attraction and are operable to retain the tray in the tray up position;

a plurality of shelves disposed within the cabinet body, wherein at least one shelf of the plurality of shelves has a width less than a full width of the cabinet body so as to provide increased vertical clearance adjacent the shelf;

a plurality of containers disposed upon the plurality of shelves, wherein each container consists of a container body having an open top through which contents are accessed, and wherein a subset of the plurality of containers further consists of a container lid adapted to close the container body;

at least one receptacle detachably coupled to at least one of the rear panel, the left side panel, or the right panel of the cabinet body, wherein the receptacle is an open-top vessel made of a flame-retardant material and configured to hold butts created during consumption of the smoking product;

a mirror mounted to an interior-facing surface of the rear panel of the cabinet body, wherein the mirror is positioned to reflect an image of a user when the cabinet door is in the open position; and, a plurality of LED lights disposed around a perimeter of the interior-facing surface of the rear panel, wherein the plurality of LED lights are adapted to illuminate the interior of the cabinet body, the tray, and a user when the cabinet door is in the open position.

* * * * *